US006503150B1

(12) United States Patent
Holmes

(10) Patent No.: US 6,503,150 B1
(45) Date of Patent: Jan. 7, 2003

(54) GOLF PRACTICE DEVICE

(76) Inventor: Scott Travis Holmes, 145 Columbia Ave., Apartment 538, Holland, MI (US) 49423

( * ) Notice: Subject to any disclaimer, the term of this patent is extended or adjusted under 35 U.S.C. 154(b) by 0 days.

(21) Appl. No.: 09/899,701

(22) Filed: Jul. 5, 2001

(51) Int. Cl.[7] ..... A63B 57/00; A63B 69/36

(52) U.S. Cl. ..... 473/229; 473/219

(58) Field of Search ..... 473/139, 149, 473/150, 187, 140, 147, 142, 229, 238, 262, 264, 265, 278, 279, 405, 423, 425, 424, 431; 273/317.8, 331, 343, 348; D21/791, 792

(56) References Cited

U.S. PATENT DOCUMENTS

| | | | | | |
|---|---|---|---|---|---|
| 2,469,002 | A | * | 5/1949 | Quattrin | 473/139 |
| 3,051,491 | A | * | 8/1962 | Cabot | 473/147 |
| 3,626,502 | A | * | 12/1971 | Weil | 473/423 |
| 3,992,011 | A | | 11/1976 | Jessee | |
| 4,071,250 | A | | 1/1978 | Vroome | |
| 4,092,027 | A | | 5/1978 | Carter | |
| 4,093,234 | A | | 6/1978 | Barton | |
| 4,177,995 | A | | 12/1979 | Surland | |
| 4,407,503 | A | | 10/1983 | Nishizawa | |
| 4,496,156 | A | | 1/1985 | Centafanti | |
| 4,522,406 | A | | 6/1985 | Tarquinio | |
| 4,526,374 | A | | 7/1985 | Ban | |
| 4,655,460 | A | | 4/1987 | Hambright | |
| 4,660,835 | A | | 4/1987 | Locurto | |
| 4,858,934 | A | | 8/1989 | Ladick et al. | |
| 4,861,035 | A | | 8/1989 | Page | |
| 4,875,685 | A | * | 10/1989 | Ballinger et al. | 473/279 |
| 4,927,154 | A | | 5/1990 | Boyer et al. | |
| 4,932,660 | A | | 6/1990 | Wang | |
| 4,932,663 | A | | 6/1990 | Makar | |
| 4,989,877 | A | | 2/1991 | Bias | |
| 5,011,155 | A | | 4/1991 | Udomkesmalee et al. | |
| 5,056,790 | A | | 10/1991 | Russell | |
| 5,098,094 | A | * | 3/1992 | Kita | 473/423 |
| 5,108,105 | A | | 4/1992 | Shimizu | |
| 5,116,059 | A | | 5/1992 | Pelletier | |
| 5,161,802 | A | | 11/1992 | Daechsel | |
| 5,181,723 | A | | 1/1993 | Brown | |
| 5,275,406 | A | | 1/1994 | Smagula | |
| 5,375,833 | A | | 12/1994 | Marier, Jr. | |
| 5,386,997 | A | | 2/1995 | Smith | |
| 5,390,930 | A | | 2/1995 | Hu et al. | |
| 5,458,336 | A | | 10/1995 | Miller | |
| 5,470,072 | A | | 11/1995 | Cunningham | |
| 5,513,847 | A | | 5/1996 | Hu et al. | |
| 5,544,886 | A | | 8/1996 | VanSkiver | |
| 5,593,355 | A | | 1/1997 | Beaver | |
| 5,599,238 | A | | 2/1997 | Roderick | |
| 5,662,527 | A | | 9/1997 | Jacquinot et al. | |
| 5,685,782 | A | | 11/1997 | Lipps et al. | |
| 5,692,967 | A | | 12/1997 | Guyer | |
| 5,720,670 | A | | 2/1998 | Oxley et al. | |
| 5,762,562 | A | | 6/1998 | Tiedge | |
| 5,782,701 | A | | 7/1998 | O'Bryan | |

(List continued on next page.)

OTHER PUBLICATIONS

Callister, Jr. William D., Materials Science and Engineering: An Introduction, 4th Edition, New York: John Wiley & Sons, Inc. , copyright 1997, p. 498.*

The Random House College Dictionary, Revised Edition. New York: Random House, Inc., 1979, p. 329.*

*Primary Examiner*—Paul T. Sewell
*Assistant Examiner*—Alvin A. Hunter, Jr.
(74) *Attorney, Agent, or Firm*—King & Jovanovic, PLC

(57) ABSTRACT

A golf practice device comprising: a spring assembly, wherein the spring assembly is capable of at least partially reducing kinetic energy of an associated golf ball; a golf ball, wherein the golf ball is associated with the spring assembly; and a damper assembly, wherein the damper assembly is capable of at least partially dissipating kinetic energy of the golf ball.

18 Claims, 6 Drawing Sheets

U.S. PATENT DOCUMENTS

| | | | |
|---|---|---|---|
| 5,865,683 | A | 2/1999 | Yang |
| 5,885,164 | A | 3/1999 | Wheatley |
| 5,885,167 | A | 3/1999 | St. Martin |
| 5,888,147 | A | 3/1999 | Luedtke |
| 5,897,442 | A | 4/1999 | Honderd |
| 5,993,326 | A | 11/1999 | Hitchman et al. |
| 5,997,405 | A | 12/1999 | Russell et al. |
| 6,106,407 | A | 8/2000 | Peyton, Jr. |
| 6,129,637 | A | 10/2000 | Wang et al. |
| 6,156,396 | A | 12/2000 | Florian |
| 6,174,243 | B1 | 1/2001 | Choi |

* cited by examiner

GOLF PRACTICE DEVICE

BACKGROUND OF THE INVENTION

1. Field of the Invention

The present invention relates in general to a golf practice device, and more particularly, to an indoor/outdoor golf practice device having a spring assembly and a damper assembly which, among other things, cooperatively facilitate use of the device in confined environments without sacrificing requisite feel for appropriate feedback toward correcting and/or grooving of a golfer's swing.

2. Background Art

Golf practice devices have been known in the art for years, and are the subject of numerous patents, including: U.S. Patent No. U.S. Pat. No. 6,174,243 B1 entitled "Golf Ball Feeder for Use in Golf Practice Court;" U.S. Pat. No. 6,156,396 entitled "Golf Practice Mat;" U.S. Pat. No. 6,129,637 entitled "Golf Practice Device;" U.S. Pat. No. 6,106,407 entitled "Golf Practice and Analyzer System;" U.S. Pat. No. 5,997,405 entitled "Golf Practice Device;" U.S. Pat. No. 5,993,326 entitled "Golf Practice Device;" U.S. Pat. No. 5,897,442 entitled "Golf Practice and Training Device;" U.S. Pat. No. 5,888,147 entitled "Divot Hit/Portable Golf Practice Mat;" U.S. Pat. No. 5,885,167 entitled "Ball Support and Golf Swing Aid for Golf Practice;" U.S. Pat. No. 5,885,164 entitled "Golf Practice Aid;" U.S. Pat. No. 5,865,683 entitled "Simplified Golf Practice Equipment;" U.S. Pat. No. 5,782,701 entitled "Golf Practice Aid;" U.S. Pat. No. 5,762,562 entitled "Golf Practice Device;" U.S. Pat. No. 5,720,670 entitled "Golf Practice Apparatus;" U.S. Pat. No. 5,692,967 entitled "Golf Practice Device;" U.S. Pat. No. 5,685,782 entitled "Golf Practice Apparatus;" U.S. Pat. No. 5,662,527 entitled "Golf Practice Device;" U.S. Pat. No. 5,599,238 entitled "Golf Practice Device;" U.S. Pat. No. 5,593,355 entitled "Golf Practice Apparatus;" U.S. Pat. No. 5,544,886 entitled "Golf Practice Device;" U.S. Pat. No. 5,513,847 entitled "Magnetically Restored Golf Practice Device with Visual and Audio Display;" U.S. Pat. No. 5,470,072 entitled "Golf Practice Device;" U.S. Pat. No. 5,458,336 entitled "Golf Practice Aid;" U.S. Pat. No. 5,390,930 entitled "Magnetically Restored Golf Practice Device;" U.S. Pat. No. 5,386,997 entitled "Portable Golf Practice Apparatus;" U.S. Pat. No. 5,375,833 entitled "Golf Practice Device;" U.S. Pat. No. 5,275,406 entitled "Golf Practice Device;" U.S. Pat. No. 5,181,723 entitled "Golf Practice Device;" U.S. Pat. No. 5,161,802 entitled "Golf Practice Device;" U.S. Pat. No. 5,116,059 entitled "Golf Practice Apparatus;" U.S. Pat. No. 5,108,105 entitled "Golf Practice Device;" U.S. Pat. No. 5,056,790 entitled "Golf Practice Device;" U.S. Pat. No. 5,011,155 entitled "Golf Practice Device;" U.S. Pat. No. 4,989,877 entitled "Golf Practice Device;" U.S. Pat. No. 4,932,663 entitled "Golf Practice Swing Tee Mat;" U.S. Pat. No. 4,932,660 entitled "Golf Practice Device;" U.S. Pat. No. 4,927,154 entitled "Golf Practice Device;" U.S. Pat. No. 4,861,035 entitled "Golf Practice Apparatus;" U.S. Pat. No. 4,858,934 entitled "Golf Practice Apparatus;" U.S. Pat. No. 4,660,835 entitled "Tethered Ball Golf Practice Device;" U.S. Pat. No. 4,655,460 entitled "Golf Practice Device;" U.S. Pat. No. 4,526,374 entitled "Golf Practice Device;" U.S. Pat. No. 4,522,406 entitled "Golf Practice Game;" U.S. Pat. No. 4,496,156 entitled "Golf Practice Device;" U.S. Pat. No. 4,407,503 entitled "Golf Practice Device;" U.S. Pat. No. 4,093,234 entitled "Golf Practice Device;" U.S. Pat. No. 4,092,027 entitled "Golf Practice Device;" U.S. Pat. No. 4,071,250 entitled "Golf Practice Drive Analyzer;" U.S. Pat. No. 4,177,995 entitled "Golf Practice Device;" and U.S. Pat. No. 3,992,011 entitled "Heads Down Golf Practice Device" all of which are hereby incorporated herein by reference in their entirety.

U.S. Pat. No. 6,129,637 discloses a golf practice device comprising a base having on the top surface a section of artificial turf and a positioning support. A rod is pivot mounted to the front end of the positioning support and the leading end of the rod is pivot mounted to a ball to form the directional control mount. The rod of the directional control mount is inserted such that the ball enters a threaded section, at the bottom end of which is the connection rod of a swivel mount having an internal spherical-shaped space, and until the threaded section is situated laterally against the ball of the direction control mount. This enables assembly to the swivel mount so that the ball of the direction control mount is contained in the swivel fitting of the swivel assembly. The swivel mount and the connection rod at the top and bottom ends of the swivel assembly are structurally coordinated with a golf ball at the bottom end of another rod forming the golf ball assembly. Following the assembly of the device, while the user is engaged in golf club swinging practice, the invention purportedly offers increased practical performance by indicating to the user whether the golf club has hit the golf ball squarely or not and, furthermore, allows for appropriate corrections.

U.S. Pat. No. 5,865,683 discloses a golf practice device which comprises a rectangular base block, an "L" shaped metal supporting plate mounted on one side of the base block by nuts, a steel cantilever shaft having one end fixed to a vertical slot of the vertical portion of the supporting plate by a nut and a ball swinging rod having a mounting socket at the top for sleeving over the free end of the cantilever shaft and retained by a nut and a washer, and a target ball at a free end of the ball swinging rod.

U.S. Pat. No. 5,544,886 discloses a system for enabling golf practice to be held in a limited space including: a cylindrical, PVC, pipe casing containing weight means and having a first end with an end cap fastened thereon, an eye bolt fastened to the first end cap, and a second end having an end cap fastened thereon, forming a sealed container for the weight means, a golf ball having a bore formed therethrough at the diameter, the bore countersunk at one end, and a tethering cord having a first end and a second end, the cord secured at the first end to the golf ball, the cord passing through the bore and secured therein, and shaped to conform to the outer surface of the golf ball at the first end, and the tethering cord secured at a second end to the eye bolt, the second end passing through the eye bolt, and secured to itself by a clamp, thereby forming a loop, whereby when the golf ball, the cord and the pipe casing are strung out in alignment and the ball is struck by a golf club, the ball will travel along it natural trajectory until restrained by the weight pipe casing, thereby allowing viewing of at least the initial portion of the trajectory of the ball and enabling the ball to travel substantially double the distance of the length of the cord.

U.S. Pat. No. 5,056,790 discloses a golf practice device in which a practice ball is connected by a flexible cord to a ball-control frame mounted rotatably on a base, characterized in that: when the device is arranged operatively, the base is secured at a location at which a golf club may be swung to strike said ball, the flexible cord being substantially inelastic and acting, when the ball is struck, to effect rotation of the ball-control frame, the latter having damping means arranged to allow the cord to extend to an extent commensurate with the striking force on the ball.

U.S. Pat. No. 4,177,995 discloses a drag member having a flexible, self-sustaining form which is centrally attached to a golf ball by a flexible elongated member. The drag member comprises a substantially planar central portion and radial segments extending outwardly from the central portion. When the golf ball is driven through the air, the drag member is pulled behind the ball transverse to the trajectory of the ball. The drag member defines an aerodynamically designed drag surface area of initially fixed dimensions which vary inversely with the flight speed of the device. The drag member acts to shorten the flight of the golf ball and to provide a flight trajectory for the attached golf ball similar to that of a conventional golf ball.

While the above-identified patents do appear to provide operable practice devices, their configurations remain non-desirous and/or problematic inasmuch as none of the above-identified devices appear to be: (a) readily adaptable for confined indoor or spacious outdoor use; (b) easily convertible from a storage configuration to a use configuration; and (c) materially able to provide a user with the feel of hitting a real golf ball when time, weather, and/or space prohibit hitting an unrestricted golf ball, such as on a course, range, field, etc.

It is therefore an object of the present invention to provide a golf practice device which, among other things, remedies the aforementioned detriments and/or complications associated with the use of the above-identified golf practice devices.

SUMMARY OF THE INVENTION

The present invention is directed to a golf practice device comprising: (a) a spring assembly, wherein the spring assembly is capable of at least partially reducing kinetic energy of an associated golf ball; (b) a golf ball, wherein the golf ball is associated with the spring assembly; and (c) a damper assembly, wherein the damper assembly is capable of at least partially dissipating kinetic energy of the golf ball.

In a preferred embodiment of the present invention, the spring assembly includes a spring which emanates generally parallel to an intended flight vector of the golf ball. In this embodiment the spring assembly may comprise a compression spring.

In another preferred embodiment of the present invention, the golf ball is tethered directly to the spring assembly.

Preferably, the damper assembly is capable of redirecting the golf ball back toward an initial position prior to being struck by a golf club.

In yet another preferred embodiment of the present invention the golf practice device further comprises at least one spring assembly guard, wherein at least one spring assembly guard prevents the golf ball from contacting the spring assembly.

The present invention is also directed to a golf practice device comprising: (a) a spring assembly attached to a spring assembly base, wherein the spring assembly is capable of at least partially reducing kinetic energy of an associated golf ball; (b) at least one spring assembly guard attached to the spring assembly base, wherein the spring assembly guard prevents the golf ball from contacting the spring assembly; (c) a golf ball, wherein the golf ball is associated with the spring assembly; (d) a damper assembly attached to a damper assembly base, wherein the damper assembly comprises a damper support and a damper pad which emanate generally upward from the damper assembly base, and wherein the damper assembly is capable of at least partially dissipating kinetic energy of the golf ball.

In a preferred embodiment of the present invention, the spring assembly base and the damper assembly base are hingably secured to each other, thereby enabling the golf practice device to articulate from a storage position wherein the spring assembly base is positioned below the damper assembly base, to a use position wherein the spring assembly base is positioned adjacent the damper assembly base.

In another aspect of the present invention the damper assembly further comprises a handle for transporting the golf practice device when in the storage position.

The present invention is also directed to a golf practice device comprising: (a) a spring assembly attached to a spring assembly base, wherein the spring assembly is capable of at least partially reducing kinetic energy of an associated golf ball, and further wherein the spring assembly comprises a compression spring which emanates generally parallel to an intended flight vector of the golf ball; (b) at least one spring assembly guard attached to the spring assembly base, wherein the spring assembly guard prevents the golf ball from contacting the spring assembly; (c) a golf ball, wherein the golf ball is associated with the spring assembly; (d) a damper assembly attached to a damper assembly base, wherein the damper assembly comprises a damper support and a damper pad which emanate generally upward from the damper assembly base, and wherein the damper assembly is capable of at least partially absorbing kinetic energy of the golf ball, and further wherein the damper assembly is capable of redirecting the golf ball back toward an initial position prior to being struck by a golf club.

BRIEF DESCRIPTION OF THE DRAWINGS

The invention will now be described with reference to the drawings wherein.

DETAILED DESCRIPTION OF THE INVENTION

Figure 1:
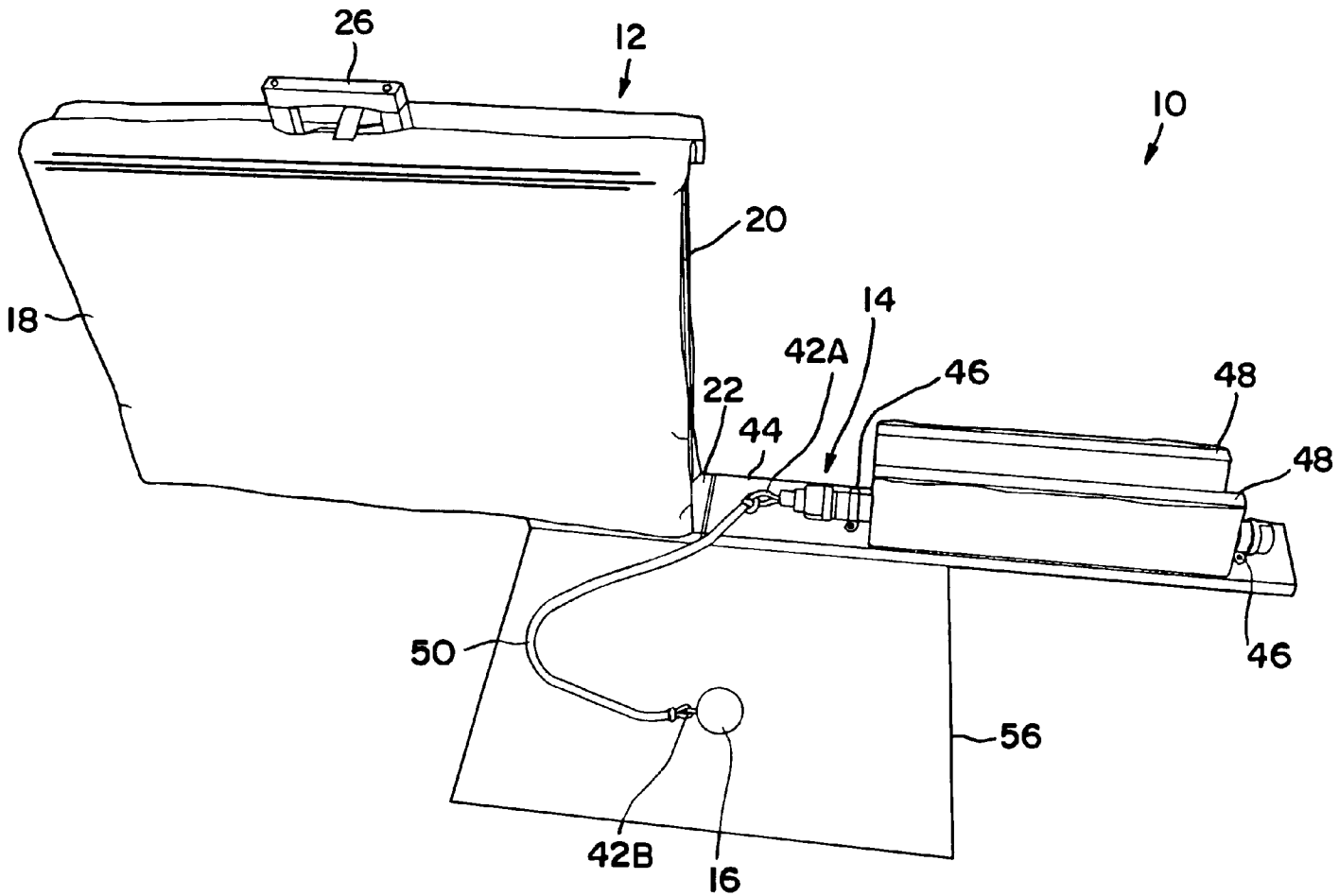
FIG. 1 of the drawings is a perspective view of a golf practice device fabricated in accordance with the present invention showing the device in a use configuration.

While this invention is susceptible of embodiment in many different forms, there is shown in the drawings and described herein in detail several specific embodiments with the understanding that the present disclosure is to be considered as an exemplification of the principles of the invention and is not intended to limit the invention to the embodiments illustrated.

It will be understood that like or analogous elements and/or components, referred to herein, may be identified throughout the drawings with like reference characters.

Referring now to the drawings, and to FIG. 1 in particular, a perspective view of a first embodiment of golf practice device 10 is shown which generally comprises damper assembly 12, spring assembly 14, and golf ball 16. It will be understood that FIG. 1 is merely a representation of golf practice device 10. As such, some of the components may be distorted from their actual scale for pictorial clarity.

As will be explained in greater detail below, damper assembly 12 and spring assembly 14, cooperatively facilitate use of golf practice device 10 in confined environments without sacrificing requisite feel for appropriate feedback toward correcting and/or grooving of a golfer's swing. Moreover, golf practice device 10: (a) is readily adaptable for confined indoor or spacious outdoor use; (b) is easily convertible from a storage configuration to a use configuration; and (c) materially provides a user with the feel of hitting a real golf ball when time, weather, and/or space prohibit hitting an unrestricted golf ball, such as on a course, range, field, etcetera.

Damper assembly 12 is capable of at least partially dissipating kinetic energy of golf ball 16 upon being struck by a golf club of a user. It will be understood that the degree of kinetic energy dissipation will vary depending upon, among other things, the material and geometric configuration, including thickness of damper pad 18. In addition, damper assembly 12 is capable of redirecting golf ball 16 back toward an initial position prior to being struck by a golf club of a user, as is shown in FIG. 1. This repositioning of the golf ball is further assisted by re-extension of the compressed spring in the spring assembly.

Figure 2:
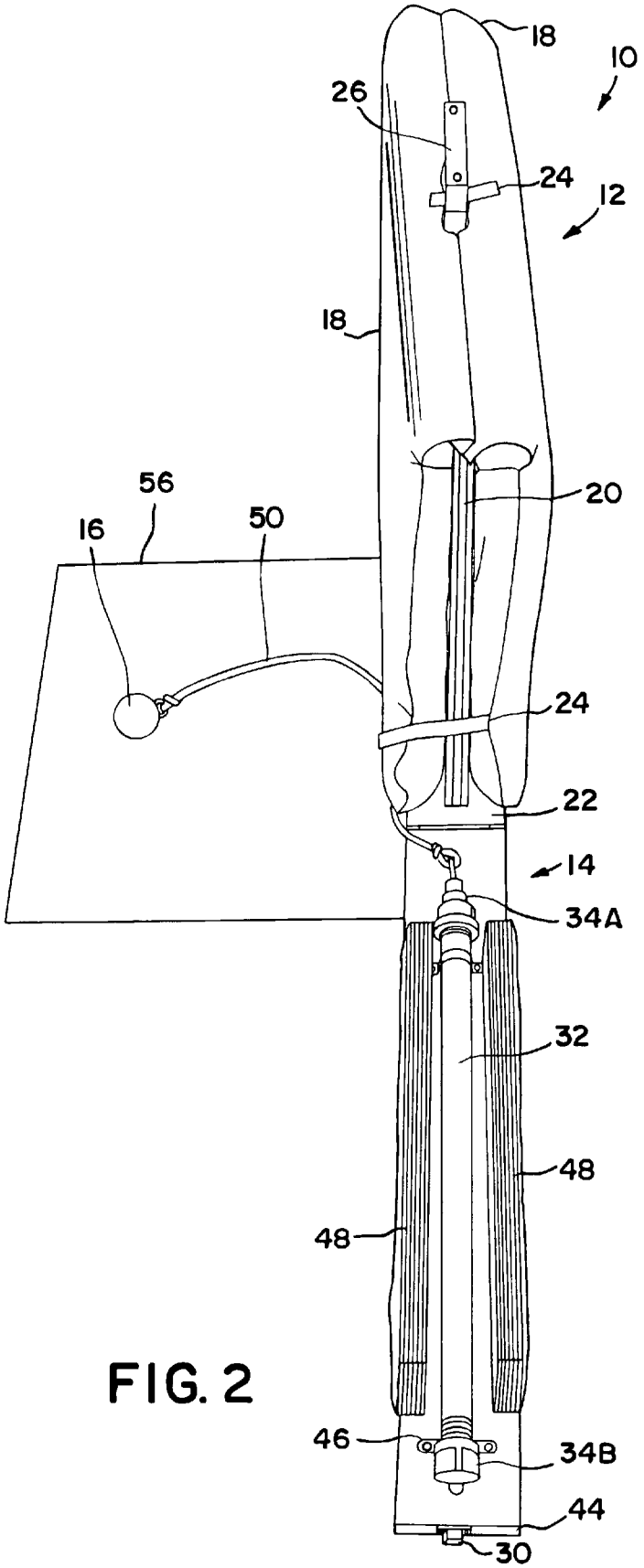
FIG. 2 of the drawings is a rear perspective view of a golf practice device fabricated in accordance with the present invention.

Referring now to FIGS. 1 and 2 collectively, damper assembly 12 includes damper pad 18 and damper support 20 which emanate generally upward from damper assembly base 22. Damper pad 18 generally surrounds damper support 20 and is secured thereto via a plurality of conventional loop and hook fasteners 24. It will be understood, however, that damper pad 18 may be secured to damper support 20 using any one of a number of fasteners that would be known to those having ordinary skill in the art having the present disclosure before them. For purposes of the present disclosure, damper pad 18 is fabricated from a polyurethane foam core which is covered by fabric, although numerous other dampening structures are contemplated for use, such as resilient natural and/or synthetic polymeric resins, plastics, sponges, cotton, wool, leather—just to name a few.

Damper support 20 provides the general structure for damper assembly 12 and may be fabricated from, for example, woods, metals, natural resins, synthetic resins, plastics, composites, and mixtures thereof. Damper support 20 is secured to damper assembly base 22 via a plurality of conventional threaded fasteners. Of course, damper support 20 may be secured to damper assembly base 22 using any one of a number of fasteners, including screws, bolts, nails, pins, anchors, rivets, and/or adhesives or bonding agents—just to name a few. Furthermore, although not shown, it is likewise contemplated that damper support 20 and damper assembly base 22 may be fabricated from a unitary piece of material or, alternatively, integrally molded together without fasteners.

Figure 6:
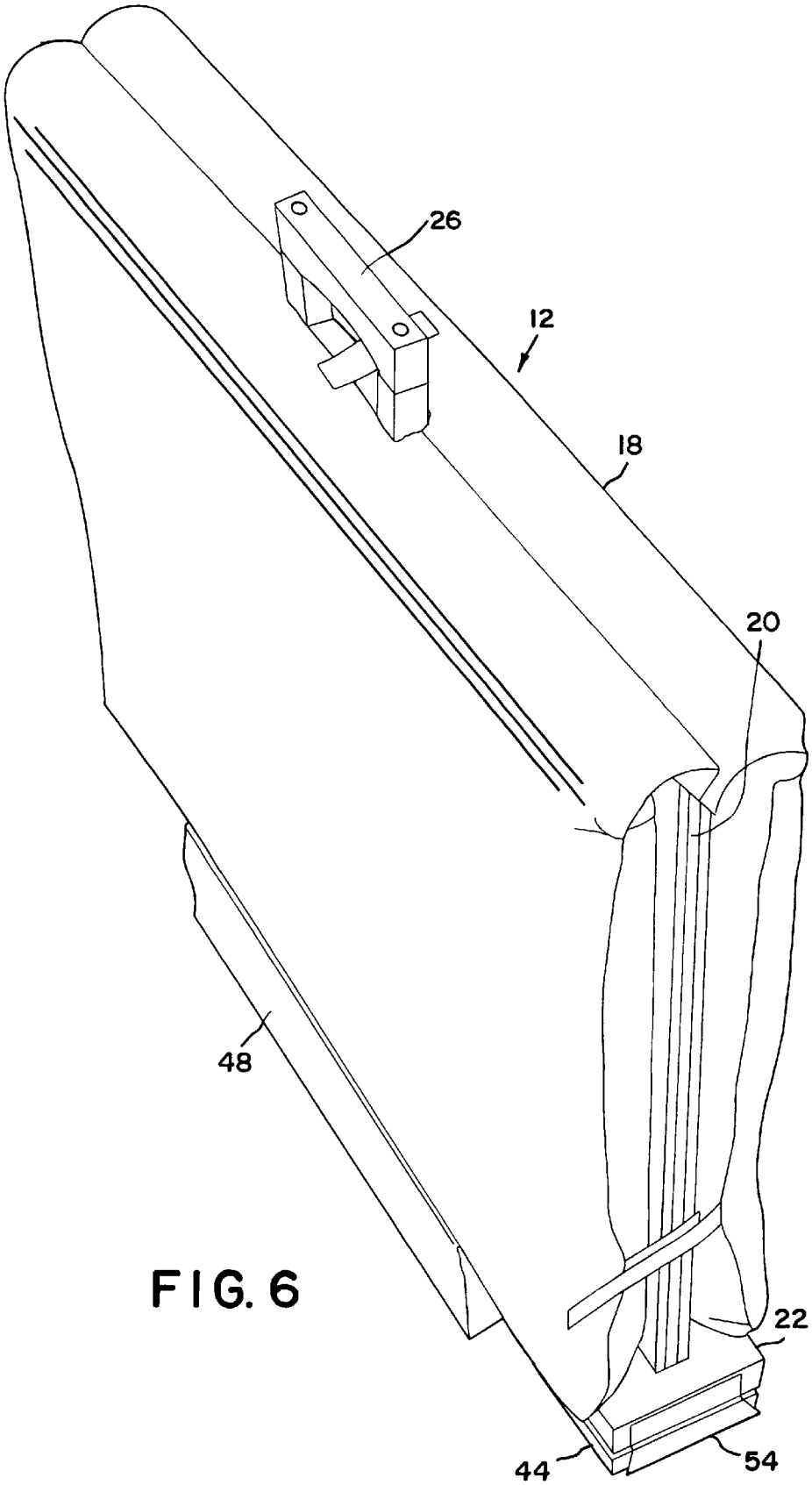
FIG. 6 of the drawings is a fragmented perspective view of a golf practice device fabricated in accordance with the present invention showing, among other things, a hinge connecting a spring assembly base to a damper assembly base.
Figure 7:
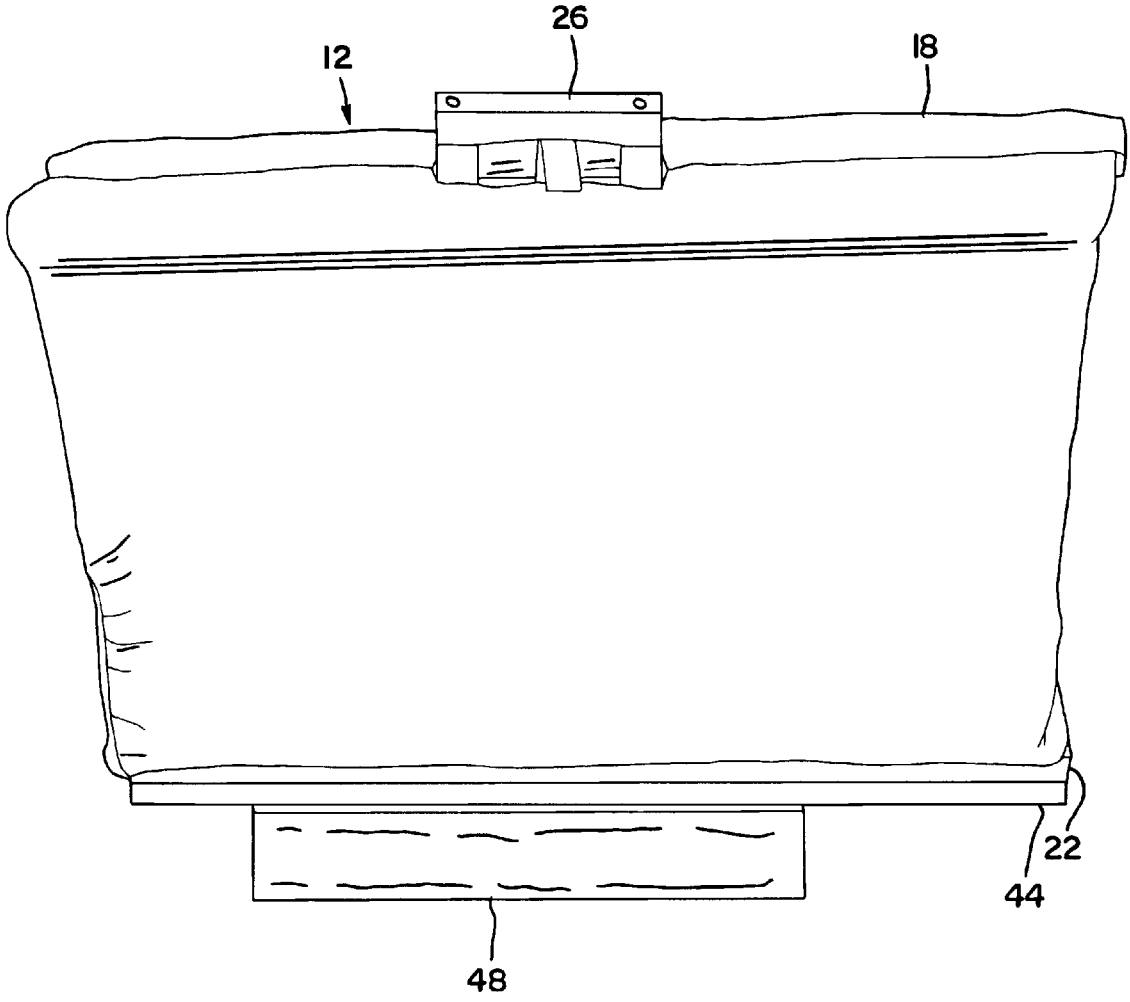
FIG. 7 of the drawings is a fragmented perspective view of a golf practice device fabricated in accordance with the present invention showing the device in a storage configuration.

Referring now to FIGS. 6 and 7, damper assembly 12 further includes handle 26 which conveniently enables a user to transport golf practice device when in a storage configuration.

Figure 3:
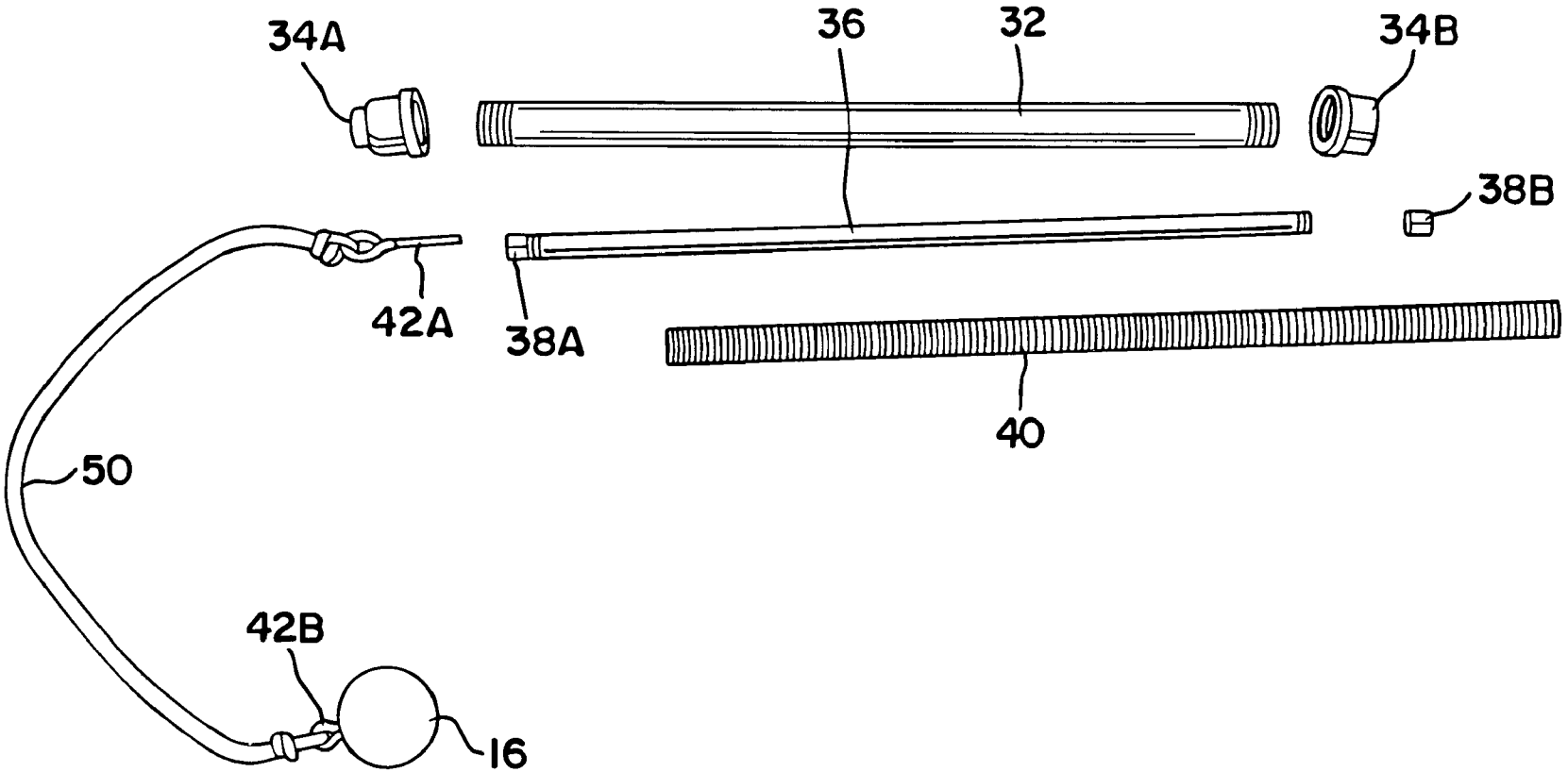
FIG. 3 of the drawings is a top plan view of an unassembled spring assembly fabricated in accordance with the present invention.

Referring once again to FIG. 1, spring assembly 14 is capable of at least partially dissipating kinetic energy of golf ball 16, and substantially contributes to providing a user with the feel of hitting a real golf ball. As is best shown in FIG. 3, spring assembly 14 generally includes outer housing 32, outer housing caps 34A and 34B, rod 36, rod caps 38A and 38B, and spring 40. It will be understood that while a particular spring has been identified, for illustrative purposes only, any one of a number of springs or biasing members are suitable for use in accordance with the present invention, including flat, leaf, helical, spiral, torsion bar, disk, compression, and/or constant force springs. Moreover, regardless of its ordinary meaning, the term "spring" will herein be defined as any mechanism which may be provided in a free body diagram as having the capability of storing, releasing, absorbing, and/or dissipating energy as a function of displacement. Therefore, even a fluid may comprise a spring, such as in a fluid pressure system. Furthermore, spring 40 may comprise any shape and may be fabricated from any material that is at least partially elastic and/or displaceable.

Upon assembly of spring assembly 14, rod cap 38B is secured to one end of rod 36 in a conventional threaded manner. Rod 36 is then placed inside of spring 40, which, in turn, is placed inside of outer housing 32 having outer housing cap 34B threadably secured thereto. Next outer housing cap 34A is placed over rod 36 and threadably secured to outer housing 32. Once outer housing cap 34A is properly secured, rod cap 38A is threadably secured to rod 36 which is positioned outside of outer housing cap 34A. Finally, pin 42A is threadably secured to rod cap 38A. While the above-identified spring assembly components have been disclosed as being threadably secured, it will be understood that any one of a number of securing mechanisms are contemplated for use in accordance with the present invention.

Figure 4:
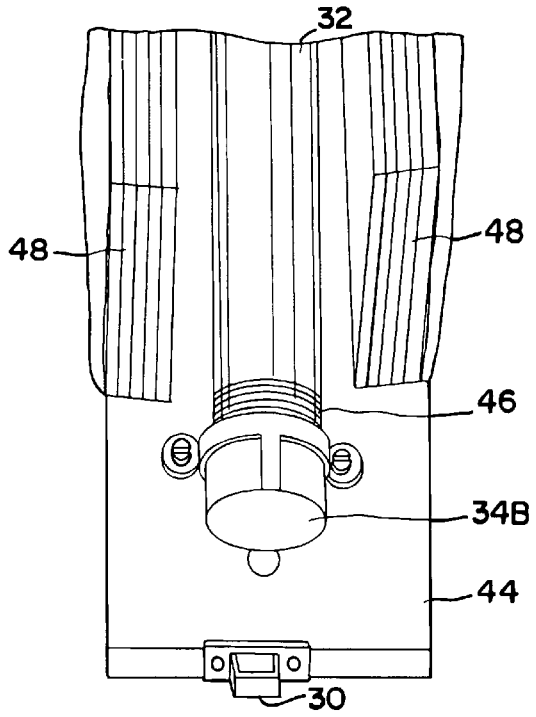
FIG. 4 of the drawings is a fragmented perspective view of a spring assembly, a spring assembly guard, and a spring assembly base fabricated in accordance with the present invention.

As is best shown in FIGS. 1, 2, and 4 collectively, after construction, spring assembly 14 may be fastened to spring assembly base 44 via C-shaped clamps 46 which are threadably secured to spring assembly base 44.

As is shown in FIG. 1, spring assembly 14 is preferably configured so it emanates generally parallel to an intended flight vector of the golf ball.

As is further shown in FIG. 1, golf ball 16 is associated with spring assembly 14. In particular, golf ball 16 may be directly tethered to spring assembly 14 using a pins 42A and 42B and nylon rope 50. It will be understood, of course, that golf ball 16 may be tethered to spring assembly 14 using anyone of a number of conventional tethering mechanisms that would be known to those having ordinary skill in the art having the present disclosure before them.

Referring now collectively to FIGS. 1, 2, and 4, golf practice device 10 may include one or more spring assembly guards 48 which prevent golf ball 16 from inadvertently contacting spring assembly 14. Such a guard can be especially helpful in preventing pin 42B from breaking upon striking spring assembly 14.

Figure 5:
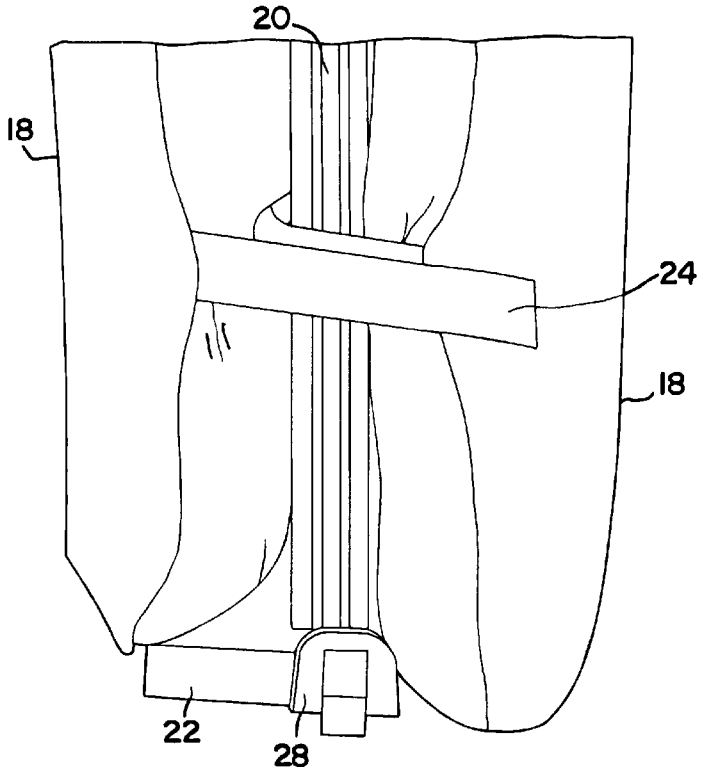
FIG. 5 of the drawings is a fragmented perspective view of a damper assembly and a damper assembly base fabricated in accordance with the present invention.

As is best shown in FIGS. 4 and 5, clamp 28 is secured to damper assembly base 22 which in cooperation with peg 30 of spring assembly base 44 enables golf device 10 to be releasably secured in a storage position.

In accordance with the present invention, golf practice device 10 is readily convertible from a use position (FIG. 1) to a storage/transportation position (FIG. 7) via hinge 54 which is shown in FIG. 6.

Golf practice device 10 of the present invention may be used by either left-handed or right handed golfers, and its configuration allows for practice in confined environments without sacrificing requisite feel for appropriate feedback toward correcting and/or grooving of a golfer's swing.

In operation, a golfer strikes golf ball 16 which, for indoor use, is placed on pad 56. After golf ball 16 is struck, rope 50 becomes taught which starts directing the ball in a quarter circle (to the right for a right-handed golfer, and to the. left for a left-handed golfer) which carries the golf ball directly into the damper assembly. Simultaneously, rod 36 of spring assembly 14 is displaced in the flight vector of the golf ball. Upon displacement of rod 36, spring 40 is compressed, thereby controllably at least partially reducing kinetic energy of golf ball 16. Before all kinetic energy is diminished, golf ball 16 contacts damper assembly 12, thereby at least partially further dissipating kinetic energy of the golf ball 16. Once the golf ball has been stopped and rebounded by the damper assembly, the extension of the compressed spring to its original form further assists in bringing the ball back to the hitting position. In many cases golf ball 16 is redirected back directly onto pad 56. Once golf ball 16 has come to a rested position it is ready for striking once again.

The foregoing description merely explains and illustrates the invention and the invention is not limited thereto except insofar as the appended claims are so limited, as those skilled in the art who have the disclosure before them will be able to make modifications without departing from the scope of the invention.

What is claimed is:

1. A golf practice device, comprising:

a spring assembly, with a spring having a first end and a second end;

a golf ball, wherein the golf ball is associated via a rope with the second end of the spring; and a damper assembly, having a first end and a second end, wherein the damper assembly is positioned such that the first end of the damper assembly is substantially proximate the spring assembly and the second end of the damper assembly extends away from the spring assembly in an orientation substantially parallel to the spring assembly, whereupon contact of the golf ball by a golf club, the golf ball is redirected via the spring assembly into the damper assembly.

2. The golf practice device according to claim 1, wherein the spring assembly includes a spring which emanates generally parallel to an intended flight vector of the golf ball.

3. The golf practice device according to claim 2, wherein the golf ball is tethered directly to the spring assembly.

4. The golf practice device according to claim 1, wherein the golf ball is tethered directly to the spring assembly.

5. The golf practice device according to claim 1, wherein the damper assembly is capable of redirecting the golf ball back toward an initial position prior to being struck by a golf club.

6. The golf practice device according to claim 1, further comprising at least one spring assembly guard, wherein the at least one spring assembly guard prevents the golf ball from contacting the spring assembly.

7. A golf practice device, comprising:

a spring assembly attached to a spring assembly base, with a spring having a first end and a second end;

at least one spring assembly guard attached to the spring assembly base, wherein the spring assembly guard prevents the golf ball from contacting the spring assembly;

a golf ball, wherein the golf ball is associated via a rope with the second end of the spring; and a damper assembly attached to a damper assembly base, having a first end and a second end, wherein the damper assembly comprises a damper support and a damper pad which emanate generally upward from the damper assembly base, and wherein the damper assembly is positioned such that the first end of the damper assembly is substantially proximate the spring assembly and the second end of the damper assembly extends away from the spring assembly in an orientation substantially parallel to an intended flight vector of the golf ball, whereupon contact of the golf ball by a golf club, the golf ball is redirected via the spring assembly into the damper assembly.

8. The golf practice device according to claim 7, wherein the spring assembly includes a spring which emanates generally parallel to an intended flight vector of the golf ball.

9. The golf practice device according to claim 8, wherein the golf ball is tethered directly to the spring assembly.

10. The golf practice device according to claim 7, wherein the golf ball is tethered directly to the spring assembly.

11. The golf practice device according to claim 7, wherein the damper assembly is capable of redirecting the golf ball back toward an initial position prior to being struck by a golf club.

12. The golf practice device according to claim 7, wherein the spring assembly base and the damper assembly base are hingably secured to each other, thereby enabling the golf practice device to articulate from a storage position wherein the spring assembly base is positioned below the damper assembly base, to a use position wherein the spring assembly base is positioned adjacent the damper assembly base.

13. The golf practice device according to claim 7, wherein the damper assembly further comprises a handle for transporting the golf practice device when in the storage position.

14. A golf practice device, comprising:

a spring assembly attached to a spring assembly base, with a spring having a first end and a second end;

at least one spring assembly guard attached to the spring assembly base, wherein the spring assembly guard prevents the golf ball from contacting the spring assembly;

a golf ball, wherein the golf ball is associated via a rope with the second end of the spring; and a damper assembly attached to a damper assembly base, the damper assembly base being attached to the spring assembly base, wherein the damper assembly has a face with a first end and a second end and further comprises a damper support and a damper pad which emanate generally upward from the damper assembly base, and wherein the damper assembly is positioned such that the first end of the face is substantially proximate the spring assembly and the second end of the face extends away from the spring assembly, whereupon contact of the golf ball by a golf club, the golf ball is redirected via the spring assembly into the face between the first and second ends thereof, and further wherein the damper assembly is capable of redirecting the golf ball back toward an initial position prior to being struck by a golf club.

15. The golf practice device according to claim 14, wherein the golf ball is tethered directly to the spring assembly.

16. The golf practice device according to claim 14, wherein the spring assembly base and the damper assembly base are hingably secured to each other, thereby enabling the golf practice device to articulate from a storage position wherein the spring assembly base is positioned below the damper assembly base, to a use position wherein the spring assembly base is positioned adjacent the damper assembly base.

17. The golf practice device according to claims 14, wherein the damper assembly further comprises a handle for transporting the golf practice device when in the storage position.

18. A golf practice device, comprising;

a base extending from a first end to a second end;

a spring assembly, wherein the spring assembly is positioned along a portion of the base, proximate the first end of the base;

a golf ball, wherein the golf ball is associated via a rope with the spring assembly, and a damper assembly, wherein the damper assembly extends along a portion of the base, between the first end and the second end of the base in an orientation substantially parallel to the spring assembly, such that upon contact of the golf ball by a golf club, the golf ball is redirected via the spring assembly into the damper assembly.

* * * * *